United States Patent [19]

Schildknecht

[11] 3,989,097

[45] Nov. 2, 1976

[54] DEHUMIDIFICATION CONTROLS

[75] Inventor: Walter T. Schildknecht, Madison, Wis.

[73] Assignee: Marshall Erdman and Associates, Inc., Madison, Wis.

[22] Filed: Sept. 27, 1974

[21] Appl. No.: 510,050

[52] U.S. Cl. ..... 165/21; 236/44 C

[51] Int. Cl.[2] ..... F24F 3/14

[58] Field of Search ..... 165/21, 3; 236/44 C

[56] References Cited

UNITED STATES PATENTS

| | | | |
|---|---|---|---|
| 3,352,352 | 11/1967 | Walters | 165/21 |
| 3,486,241 | 12/1969 | Coyle et al. | 34/22 |
| 3,694,925 | 10/1972 | Coyle et al. | 165/21 |
| 3,786,859 | 1/1974 | Day | 165/21 |

*Primary Examiner*—Albert W. Davis, Jr.
*Assistant Examiner*—Sheldon Richter
*Attorney, Agent, or Firm*—Merriam, Marshall, Shapiro & Klose

[57] ABSTRACT

Automatic controls are added to the low voltage control wiring of a conventional heating and air conditioning system to provide for operation of the system to dehumidify when no heating or cooling is otherwise required. Control means are installed to maintain room temperature by alternate operating of conventional cooling and heating equipment. Circuit control means prevent operation of the dehumidification-cooling equipment when the system heating unit is in operation.

2 Claims, 4 Drawing Figures

DEHUMIDIFICATION CONTROLS

BACKGROUND OF THE INVENTION

1. Field of the Invention

This invention pertains to a particular arrangement of control equipment such as humidistats and control relays to enable a conventional heating and air conditioning unit to provide a dehumidification feature without the addition of reheat equipment and without the necessity of extensive system modifications.

2. Description of the Prior Art

Prior heating and air conditioning units which were able to provide a humidity control feature included a gas or electric downstream duct heater that reheated the cooled air exiting from the dehumidifying evaporator of the air conditioning unit. Because air must be cooled to its dew point to remove moisture, the air from which moisture has been removed is objectionably cool and therefore it is undesirable to feed such cool air into a room where a draft and associated chill may be produced. Thus in any dehumidification system, after the air had been cooled to its dew point to allow moisture to condense out the air would then be fed through a relatively small reheat unit which would raise the temperature of the air from generally in the vicinity of 45° to 55° to in the vicinity of 68° to 70° which is comfortable. The reheat equipment thus used was matched to the air conditioning equipment and only sufficient to raise the temperature of dehumidified air to a comfortable level. The reheat equipment was not sufficient to provide heating alone which would be provided by a much larger heating chamber and plenum generally located upstream of the reheat equipment. Because of the requirement for a primary heating unit and the necessity of a separate reheat element, dehumidification equipment is oftentimes omitted except from the most elaborate or humidity sensitive areas. With this circuitry of this invention, the addition of a few control circuit components will enable a conventional heating and air conditioning unit, such as a rooftop unit, to provide a dehumidifying feature.

SUMMARY OF THE INVENTION

This invention is directed to a dehumidifying control circuit for use with a conventional heating and air conditioning unit which is not equipped with specialized dehumidification equipment. In other words, the control equipment provided with this invention will convert a conventional heating and air conditioning unit to provide dehumidification without the addition of reheat equipment or other auxiliary equipment and without the necessity of altering the power wiring. A control humidistat is placed in the area from which moisture is to be removed and wired in such a manner as to be in parallel with the thermostat control contact which also controls the cooling equipment. In series with the humidistat is a control contact pair which is part of a relay having a coil that is actuated upon operation of the heating equipment thereby opening these control contacts to deactivate any cooling equipment while the system heating components are in operation. This control arrangement is utilized in a heating and air conditioning unit in which the cooling coil is located upstream of the heating chamber. In the event these units are reversed wherein the heating plenum is upstream of the cooling coil or evaporator, a remote ductstat is electrically wired in series between the humidistat, and, the dehumidification control relay's normally closed contact pair, and includes a sensing and control bulb extending into the warm air duct. This ductstat is utilized to prevent operation of the cooling equipment until the temperature of the airstream is low enough to prevent extreme thermal gradients being placed across the air conditioning evaporator. The remote ductstat is not needed where the air conditioning evaporator is upstream of the heating unit because in such an installation there is no extremely hot air crossing the cooling coils of the evaporator.

It is an object of the present invention to provide a control system for adapting a conventional heating and air conditioning unit to provide constant dehumidification.

Another object of the present invention is to provide a control system which may be applied to a heating and air conditioning unit, such as a rooftop mounted unit, and which will provide dehumidification when used both with a heater upstream from an air conditioning evaporator and also with a heater downstream from the associated air conditioning evaporator.

Still another object of the present invention is to provide a room mounted humidistat in parallel with cooling equipment and including a control relay contact and series therewith so as to prevent operation of the cooling equipment when the heater unit is on.

Another object of this invention is to provide a control equipment for use with a heating and air conditioning unit wherein an air conditioning evaporator is located downstream from a heating chamber, or plenum, and which control system includes an air duct mounted ductstat which is wired in series with a room located humidistat and which will prevent operation of the cooling equipment until air in the duct stream has been cooled below a predetermined point thus preventing extreme thermal cycling of the evaporator.

Another object of this invention is to provide a dehumidification capability to a conventional heating and air conditioning unit by utilizing a room mounted humidistat in conjunction with a control relay which permits alternate but not simultaneous operation of the heating and cooling units, and included with this combination is an automatic switchover type of room mounted thermostat which provides automatic heating and cooling as it may be required to maintain a constant room temperature.

These and other objects of the invention will become apparent from reference to the following description, attached drawings, and appended claims.

DESCRIPTION OF THE INVENTION

Figure 1:
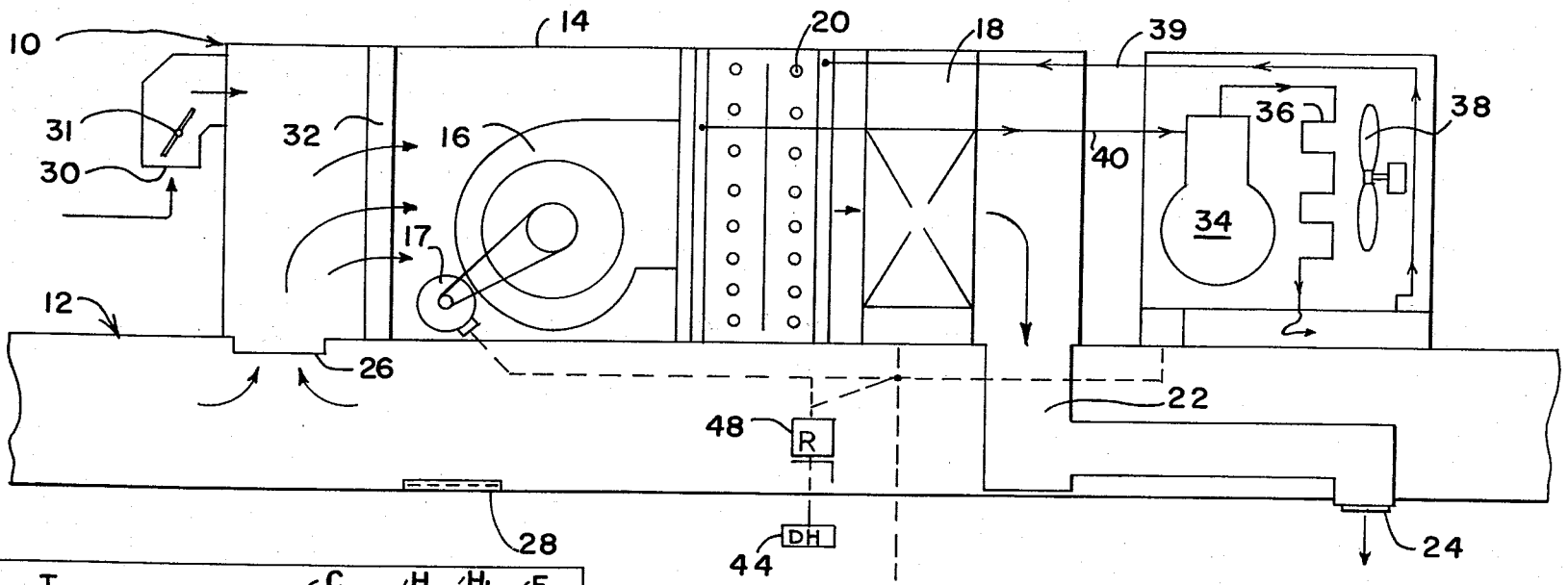
FIG. 1 is a schematic of a heating and air conditioning unit such as a rooftop unit illustrating the components thereof and schematically illustrating the control equipment used in conjunction therewith.

With reference now to the drawings, there is disclosed a heating and air conditioning unit designated generally by the numeral 10. The unit 10 is a rooftop mounted unit for purposes of this illustration, shown mounted atop a rooftop 12 which is illustrated diagrammatically. The heating and air conditioning unit includes an outside housing and associated duct 14 which encircles and protects the unit. The heating and cooling unit 10 includes a blower 16 and associated drive motor 17 which is connected therewith. A heater unit and associated heat exchanger 18 are positioned in the airstream to warm air which is being moved by the blower 16. The heat exchanger 18 is a typical furnace unit having usual fans and pumps and providing a plenum or heat exchanger in the airstream to transfer heat of combustion.

Figure 3:
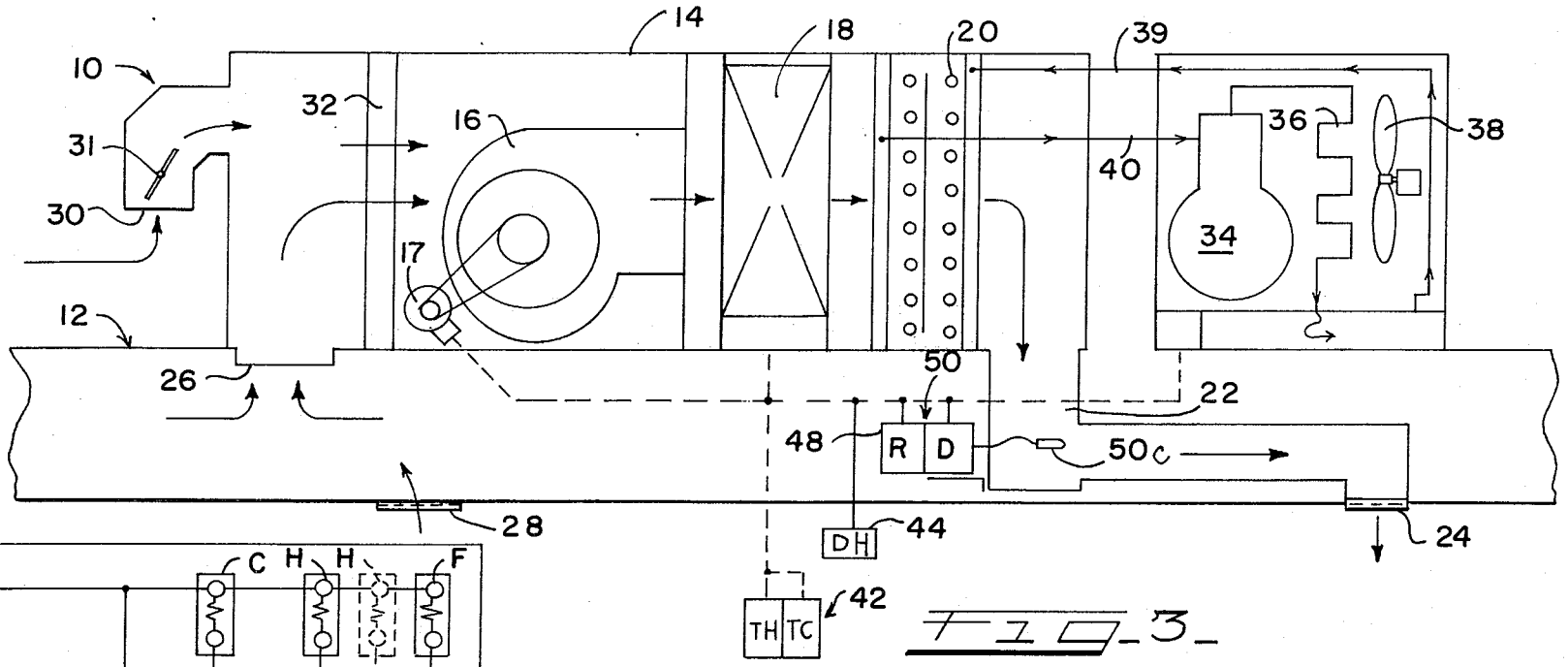
FIG. 3 is a schematic diagram of the heating and air conditioning element such as associated with a rooftop unit and showing in block diagram form, the electrical control equipment associated therewith; and, FIG. 4 is an electrical schematic diagram of the heating and air conditioning unit and associated control equipment illustrated in FIG. 3.

Also positioned in the airstream is an evaporator 20 which forms a part of an air conditioning unit and which functions to remove heat from the airstream. The configuration disclosed in FIG. 1 is an arrangement where the evaporator 20 is upstream, or closer to the blower 16, and the heating unit 18 is downstream from the evaporator 20. The arrangement shown in FIG. 3 is not as widespread and provides a unit in which the heating unit is upstream of the evaporator 20. The influence of this reversal of heating and cooling elements will be explained later in the section directed to a discussion of the electrical control equipment used to provide dehumidification.

Associated with the heating and cooling unit 10 is a discharge or outlet duct 22 leading from the main air flow chamber into a discharge outlet 24 which feeds conditioned air into a room. The heating unit also includes an inlet opening 26 which receives air from the return air duct which is provided to remove air from the room or other area through the inlet duct 28 thus providing for recirculating of conditioned air. As with most commercial units, an outside air duct 30 is provided with a rotatable or otherwise movable valve element 31 which permits fresh air to be admitted into the system. In the main duct 14 is positioned a filter element 32 which removes particles and odors from the airstream.

The air conditioning unit associated with the evaporator 20 includes any conventional compressor 34 which is compatible with the cooling requirements of the system and which may have an associated condenser element 36 and a fan 38 associated therewith. Coolant suction or return line 40 leads from the evaporator 20 to compressor 34. Liquid feed line 39 provides for flow of refrigerant from the compressor 34 to evaporator 20.

Thus the heating and cooling unit provided with this invention is the typical modular type such as mounted on a rooftop and which includes both heating and cooling equipment. The unit disclosed in the drawings does not provide any specialized dehumidifying equipment such as duct reheaters which are specifically matched to the size of the air conditioning cooling unit.

The wiring associated with the heating and cooling equipment is commonly referred to as power wiring and is heavy duty circuitry which carries the high current necessary to operate heavy duty equipment. Electrical control equipment which is matched with the power wiring generally includes electromechanical relays having low voltage control coil windings which are electromechanically coupled with power switching contacts to thereby enable a low voltage control circuit to operate at a safe level economically and with the capability of easily controlling the higher amperage power equipment. Although electromechanical control relays are disclosed, any suitable transistorized or other type of solid state elements could be used. Thus while the heating and air conditioning equipment may operate at 220 volts with an associated high amperage the thermostats 42 operate on a conventional 24-volt circuit. Each thermostat 42 used in both arrangements of FIGS. 1 and 3 is of the automatic switchover type whereby a room temperature setting is made on the thermostat and the thermostat may be placed on an automatic setting to thereby maintain room temperature at a predetermined temperature both during winter and summer months.

The room thermostats are shown in block diagram form in both FIGS. 1 and 3 and designated by the numeral 42. The associated thermostat element in each of the electrical schematics is designated by the numeral **42*a*. Each thermostat circuit 42*a*** includes a number of contacts and control elements so as to provide for automatic switchover and these elements are not disclosed here because they are widely known and any conventional automatic switchover type thermostat may be used with this invention. With the addition of a relay into the control circuit, the only modification of the thermostat would be to add approximately a ½ amp winding to the heat anticipator to compensate for the winding of the relay coil.

Thus far, there have been no alterations or changes in either the heating and cooling unit 10, the associated power wiring, or the associated control wiring which would effect operations or the warrantly coverage of any unit. This important factor was necessitated in any design which would convert a conventional heating and air conditioning unit into a unit having a dehumidification capability. By the addition of a humidistat 44 and a control relay 48 a conventional heating and air conditioning unit can be provided with dehumidification capability at minimum inconvenience and expense.

Figure 2:
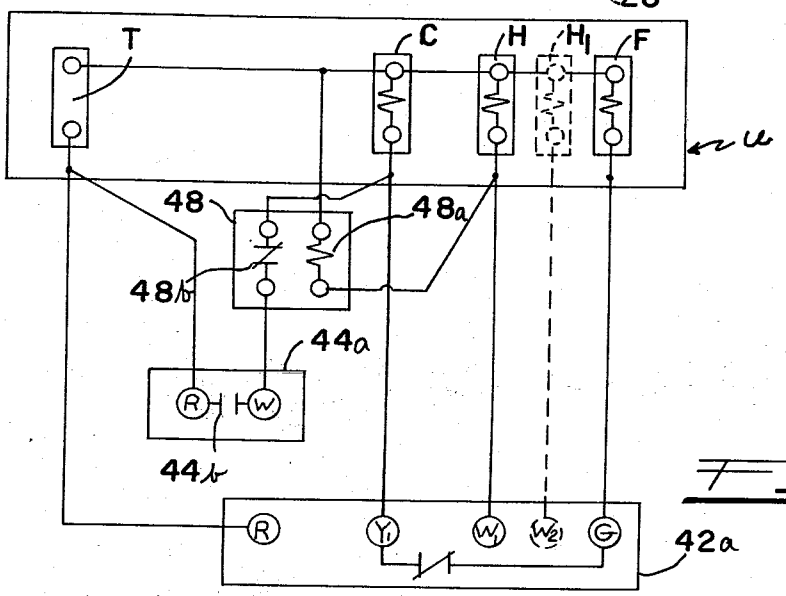
FIG. 2 is a schematic diagram of the electrical circuit associated with the heating and air conditioning and control equipment illustrated in FIG. 1.

With a heating and air conditioning unit such as that illustrated in FIG. 1 where the air conditioning evaporator is upstream of a heater 18 the control circuitry of FIG. 2 is utilized. A humidistat 44 is located in a room and designated 44a in the wiring schematic of FIG. 2. The humidistat 44 contains a humidity sensitive element which controls opening and closing of the normally opened contact pair **44*b* within the humidistat. A control relay 48*a* is wired in parallel with the heaters so that the coil of the relay 48*a* will be energized when the heaters operated by relay H are in operation. When the coil 48*a* is energized the normally closed contacts associated with the control relay 48 will open. The contacts 48*b* are in series with the normal opened contacts of the humidistat 44*a*** and thereby will prevent operation of the cooling equipment when the heating equipment is on.

Thus it is noticed that the humidistat 44 is wired in parallel with the compressor C and the control transformer T as is the thermostat control which is also wired parallel with the compressor. Thus the compressor will operate to provide cooling when the room temperature rises above the thermostat setting and will also operate when the humidistat 44 senses an undesirable level of moisture in the air. In the event the heating equipment is operating when the humidistat calls for cooling for dehumidification, operation of the cooling equipment will be prevented by the control relay 48 which is energized on operation of the heating equipment thereby opening the contacts 48*b* and thereby preventing operation of the cooling equipment. The coil 48a of the control relay 48 is wired in parallel with the heating equipment to be energized on operation of the heating equipment and the associated normally closed contact 48b of the control relay 48 is wired in series with the normally opened contacts of the humidistat 44*a*. This simple wiring arrangement may be easily made to an existing unit to provide the dehumidification which is required in many coastal and southern areas where humidity control must be provided around the clock. In these areas oftentimes the air temperature will drop during the night below a thermostat setting whereby no cooling will be called for; however, humidity increases render the air very uncomfortable even though it is relatively cool. The wiring control provided in FIG. 2 for the heating unit disclosed in FIG. 1 will dehumidify a room even when cooling is not being called for because the cooling equipment is also controlled by humidistat 44. Air passing across the air conditioning evaporator coils 20 is cooled down to a point at which moisture is removed from the air. After dehumidification, the cooling equipment shuts down and heating equipment operates to bring the room back to the thermostat setting if necessary. Generally, to maintain a room at a 60% relative humidity during hot humid weather such as encountered in the Gulf coast states, cooling to remove moisture from the air will operate for about 30 minutes, followed by heating for approximately 5 minutes.

Figure 4:
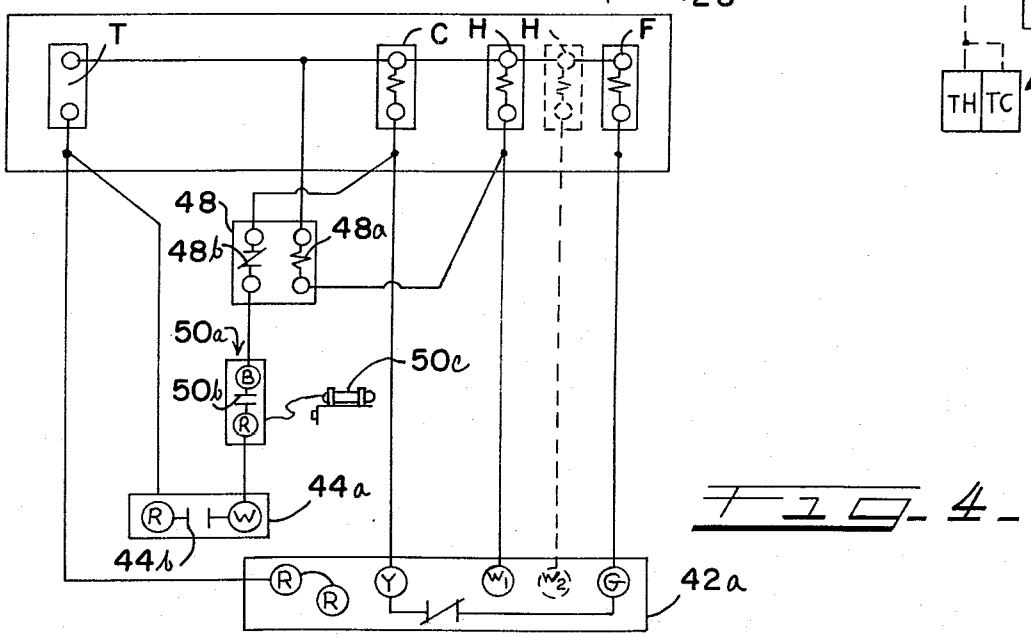

With the equipment arrangement disclosed in FIGS. 3 and 4, namely, where the air conditioning evaporator 20 is downstream from the heat exchanger 18 an additional control element is suggested. In addition to the humidistat 44*a* with the usual normally opened contacts 44*b* as is present with the arrangement previously described, a ductstat, i.e., duct thermostat designated by the numeral 50 in FIG. 3 and by the numeral 50*a* in the electrical schematic of FIG. 4 is installed. The ductstat includes contacts 50*b* which are set to open when supply plenum temperature exceeds 90°. Contact pair 50*b* is in series with the normally closed contacts 48*b* of the control relay 48 and also in series with the contacts 44*b* of the humidistat 44*a*. Associated with the ductstat 50 is a control bulb 50*c* which extends into and is positioned within the outlet duct 22 and which monitors air temperature within the outlet duct 22. Thus in operation, the temperature sensing bulb 50*c* will open and close the associated contacts 50*b* in response to air temperature. For example, as air temperature within the outlet duct 22 rises, the control bulb 50*c* will be actuated to open contacts 50*b* thus temperarily preventing operation of the air conditioning equipment even though the heating equipment is not operating (contacts 48*b* are closed) and there is high humidity in the air (contacts 44*b* are closed). As the air temperature within the outlet duct 22 is lowered the contacts 50*b* will close thus enabling the air conditioning equipment to operate. The purpose of this ductstat 50 is to prevent operation of the cooling equipment and passage of coolant through the evaporator 20 when the air is still hot thus preventing extreme thermal cycling of hot air through the evaporator coils which is not recommended.

With this invention, a conventional heating and cooling unit such as a rooftop mounted unit may be converted into a unit having a dehumidifying capability without any modification of the power wiring and only with the necessity of slight modifications and additions to the control circuitry. By providing a humidistat in parallel with the cooling equipment the air conditioning may be controlled both by the temperature demand indicated with the thermostat setting and by the humidity demand which will open and close the normally open humidistat contacts 44*b*. A control contact 48*b* is in series with the humidistat and serves to prevent operation of the cooling for dehumidification when the heating unit is in operation and has the control relay coil 48*a* energized thereby opening the contacts 48*b*. As mentioned earlier, the only circuit alteration which must be performed is to modify the heat anticipator of the thermostat by changing the amperage rating therein to compensate for the additional circuit element provided by the control coil 48*a*. The thermostat, of course, must be an automatic switchover type.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. An electrical control arrangement for use with a heating-air conditioning unit having air cooling means and air heating means to provide a dehumidification capability by utilizing the air cooling means to cool and dehumidify air and utilizing the air heating means to act as a reheater for the cooled-dehumidified air, the improvement comprising:

said heating-air conditioning unit including means for moving the air and a heat exchanger for heating said air and also including an air cooling evaporator for selectively cooling said air and removing humidity in the form of moisture from said air;

a control thermostat of the automatic switch-over type and including means for presetting a temperature for said air and including means coupled with both the air cooling means and the air heating means for automatic temperature control of said air as required by ambient conditions;

humidity control means having a humidity sensing element and having an electrical switch means;

means coupling said electrical switch means with the humidity control means for operating said switch means in response to humidity of said air;

means, including relay control means, connecting said electrical switch for operation of said air cooling means in response to operation of said switch means by the humidity sensing means;

said relay control means having a coil electrically coupled with said heating means for actuation when the heating means is heating the air; and, said relay control means having means for switching controlled by said coil and having normally closed contacts connected in series with said electrical switch means of the humidity responsive means whereby actuation of said coil when said heating of air is occuring opens said normally closed contacts to temporarily prevent operation of the air cooling means for dehumidification when the air heating means is operating and heating said air.

2. The control arrangement of claim 1, wherein said heat exchanger is downstream of said means for moving the air, and, said air cooling evaporator is downstream of said heat exchanger whereby moving air passes first through said heat exchanger and then through said evaporator; and, means for sensing air temperature positioned to monitor temperature of air flowing across said air cooling evaporator and said means for sensing has contact means electrically connected in series with said humidity responsive means to prevent operation of the air cooling means for lowering humidity when air flowing across the air cooling evaporator is hot and above a predetermined temperature to thereby prevent damage to said air cooling evaporator.

* * * * *